US007157151B2

(12) United States Patent
Creech et al.

(10) Patent No.: US 7,157,151 B2
(45) Date of Patent: Jan. 2, 2007

(54) CORROSION-RESISTANT LAYERED COATINGS

(75) Inventors: George Edward Creech, Indianapolis, IN (US); Subhash Krishna Naik, Carmel, IN (US)

(73) Assignee: Rolls-Royce Corporation, Indianapolis, IN (US)

( * ) Notice: Subject to any disclaimer, the term of this patent is extended or adjusted under 35 U.S.C. 154(b) by 304 days.

(21) Appl. No.: 10/241,331

(22) Filed: Sep. 11, 2002

(65) Prior Publication Data

US 2004/0048090 A1 Mar. 11, 2004

(51) Int. Cl.
*B21D 39/00* (2006.01)

(52) U.S. Cl. ..... 428/621

(58) Field of Classification Search ..... 428/650, 428/641, 668, 669, 670, 679, 680, 610; 416/241 R
See application file for complete search history.

(56) References Cited

U.S. PATENT DOCUMENTS

| | | | | |
|---|---|---|---|---|
| 3,979,273 | A | | 9/1976 | Panzera et al. |
| 3,999,956 | A | | 12/1976 | Stueber et al. |
| 4,070,507 | A | | 1/1978 | Stueber et al. |
| 4,339,509 | A | | 7/1982 | Dardi et al. |
| 4,439,470 | A | | 3/1984 | Sievers |
| 4,477,538 | A | | 10/1984 | Clarke |
| 4,615,864 | A | | 10/1986 | Dardi et al. |
| 4,656,099 | A | | 4/1987 | Sievers |
| 4,687,678 | A | | 8/1987 | Lindblom |
| 4,714,624 | A | | 12/1987 | Naik |
| 4,774,149 | A | | 9/1988 | Fishman |
| 5,057,196 | A | | 10/1991 | Creech et al. |
| 5,292,594 | A | | 3/1994 | Liburdi et al. |
| 5,427,866 | A | | 6/1995 | Nagaraj et al. |
| 5,482,578 | A | | 1/1996 | Rose et al. |
| 5,492,726 | A | | 2/1996 | Rose et al. |
| 5,514,482 | A | | 5/1996 | Strangman |
| 5,667,663 | A | | 9/1997 | Rickerby et al. |
| 5,688,607 | A | | 11/1997 | Rose et al. |
| 5,740,515 | A | | 4/1998 | Beele |
| 5,763,107 | A | | 6/1998 | Rickerby et al. |
| 5,780,110 | A | | 7/1998 | Schaeffer et al. |
| 5,846,605 | A | * | 12/1998 | Rickerby et al. ..... 427/570 |
| 5,873,951 | A | | 2/1999 | Wynns et al. |
| 5,922,409 | A | | 7/1999 | McMordie et al. |
| 5,942,337 | A | * | 8/1999 | Rickerby et al. ..... 428/623 |
| 5,958,204 | A | | 9/1999 | Creech et al. |

(Continued)

FOREIGN PATENT DOCUMENTS

| | | |
|---|---|---|
| EP | 0 821 078 A1 | 1/1998 |

*Primary Examiner*—Jennifer C. McNeil
*Assistant Examiner*—Gordon R. Baldwin
(74) *Attorney, Agent, or Firm*—Krieg DeVault LLP

(57) ABSTRACT

In general, the present invention provides coating systems and processes for applying a selected coating system on a metallic substrate. The coating system includes two or more coating layers. A first layer comprises a MCrAl(Y,Hf)-type coating. The MCrAl(Y,Hf) coating is overlaid with a second coating composition that includes a metallic composition different from the MCrAl(Y,Hf) coating composition and includes one or more of: a platinum, silicon containing composition; a platinum, silicon, aluminum containing composition; a platinum, silicon, chromium containing composition; an aluminum, silicon containing composition; and an aluminum, silicon, chromium containing composition; each optionally combined with one or more of chromium, hafnium, lanthanum, manganese, yttrium and mixtures of these metals. Additionally the platinum in the metallic compositions can be exchanged in whole or in part by another noble metal. The resulting coating composition is subsequently heat treated to provide a diffused multilayer corrosion-resistant coating.

5 Claims, 3 Drawing Sheets

U.S. PATENT DOCUMENTS 5,997,604 A 12/1999 Rafferty et al.
6,129,991 A * 10/2000 Warnes et al. ..... 428/610
6,296,447 B1 * 10/2001 Rigney et al. ..... 416/241 R
6,299,986 B1 10/2001 Meelu
6,355,356 B1 * 3/2002 Hasz ..... 428/472
6,406,561 B1 6/2002 Creech et al.
6,435,830 B1 * 8/2002 Allen et al. ..... 416/193 A
6,514,629 B1 * 2/2003 Rigney et al. ..... 428/632
2002/0031683 A1 * 3/2002 Lavery et al. ..... 428/668

* cited by examiner

CORROSION-RESISTANT LAYERED COATINGS

BACKGROUND OF THE INVENTION

The present invention relates to corrosion-resistant coatings for metallic articles and to methods for forming the corrosion-resistant coatings on the metallic articles. More specifically, but not exclusively, the present invention is directed to multilayered coatings and to methods for forming the layered coatings on metallic articles.

In the gas turbine engine industry, high temperature corrosion- and oxidation-resistant protective coatings for nickel-based and cobalt-based alloy components, such as turbine blades and vanes, are required. These coatings are particularly useful for new generation gas turbine engines that are designed to operate at higher turbine inlet temperatures for greater engine performance and fuel efficiency.

Current methodologies use a MCrAlY-type coating (M=Co, Ni, or Fe) to provide oxidation and hot corrosion protection for many superalloy components used in, but not restricted to, turbine engine components. The MCrAlY type coatings offer protection for Type 1 hot corrosion processes which predominate at a temperature around 1650° F. (~900° C.). However, it has been observed that, in use, some coated components exhibit corrosion patterns consistent with Type 2 corrosion processes, which typically occur around 1300° F. (~700° C.). This result may not be entirely unexpected since many superalloy components, for example, turbine components routinely used in marine environments, operate over a wide temperature range and under widely differing conditions. It would be desirable to prepare a coated alloy component that can provide extended service life under widely varying operating conditions.

A need therefore exists for advancements in the relevant field, including improved coatings that can protect the underlying substrate from oxidation and corrosion, particularly in high temperature environments, coated articles, and methods of coating the articles with high temperature, corrosion-resistant coatings. The present invention is such an advancement and provides a wide variety of benefits and advantages.

SUMMARY OF THE INVENTION

The present invention relates to corrosion-resistant coating systems and methods of providing the coating systems to metallic articles. Various aspects of the invention are novel, nonobvious, and provide various advantages. While the actual nature of the invention covered herein can only be determined with reference to the claims appended hereto, certain forms and features, which are characteristic of the preferred embodiments disclosed herein, are described briefly as follows.

In one form, the present invention provides a graded coating on a metallic substrate. The graded coating is derived from application of a MCrAl(Y,Hf) coating composition followed by application of a green coating composition. The resulting green coated substrate is then heat treated to form the diffused graded coating.

In another form, the present invention provides a coated article comprising: a metallic substrate; a first layer comprising an MCrAl(Y,Hf) alloy, where M is selected from Co, Ni, Fe and mixtures of these metals; and a second layer comprising one or more of the following combinations: a noble metal, silicon containing composition; a noble metal, silicon, aluminum containing composition; a noble metal, silicon, chromium containing composition; an aluminum, silicon containing composition; an aluminum, silicon, chromium containing composition and mixtures thereof. The compositions can be an alloy, a prealloy powder, or a green coating mixture. In preferred embodiments, the noble metal silicon or the aluminum silicon containing metallic compositions can include additional metallic components including: aluminum, chromium, hafnium, lanthanum, manganese, and yttrium.

In another form, the present invention provides a method of preparing a coated metallic article. The method comprises: applying to a metallic substrate a first coating composition comprising a MCrAl(Y,Hf) coating; and applying a second coating composition over the MCrAl(Y,Hf) coating composition, where the second coating composition comprises one or more of the following combinations: a noble metal, silicon containing composition; a noble metal, silicon, aluminum containing composition; a noble metal, silicon, chromium containing composition; an aluminum, silicon containing composition; an aluminum, silicon, chromium containing composition; a noble metal, silicon, aluminum, chromium containing composition; a noble metal, silicon, aluminum, chromium, manganese containing compositions; and mixtures thereof. The resulting coated article is heat treated to provide a diffused coating on the metallic substrate.

Regardless of the metals used, the inventive one-step method diffuses the metals into the underlying layer or substrate. Preferably, a multi-stage heating process is employed. With the multi-stage heating process, the powder-covered substrate is initially heated to a first temperature to begin the diffusion process and is then heated to a second temperature to complete the diffusion. In some embodiments, a pre-diffusion heat treatment is also used.

One object of the present invention is to provide corrosion-resistant layered coatings and methods of coating metallic articles.

Further objects and advantages of the present invention will be apparent from the description provided below.

DETAILED DESCRIPTION OF THE INVENTION

Figure 1:
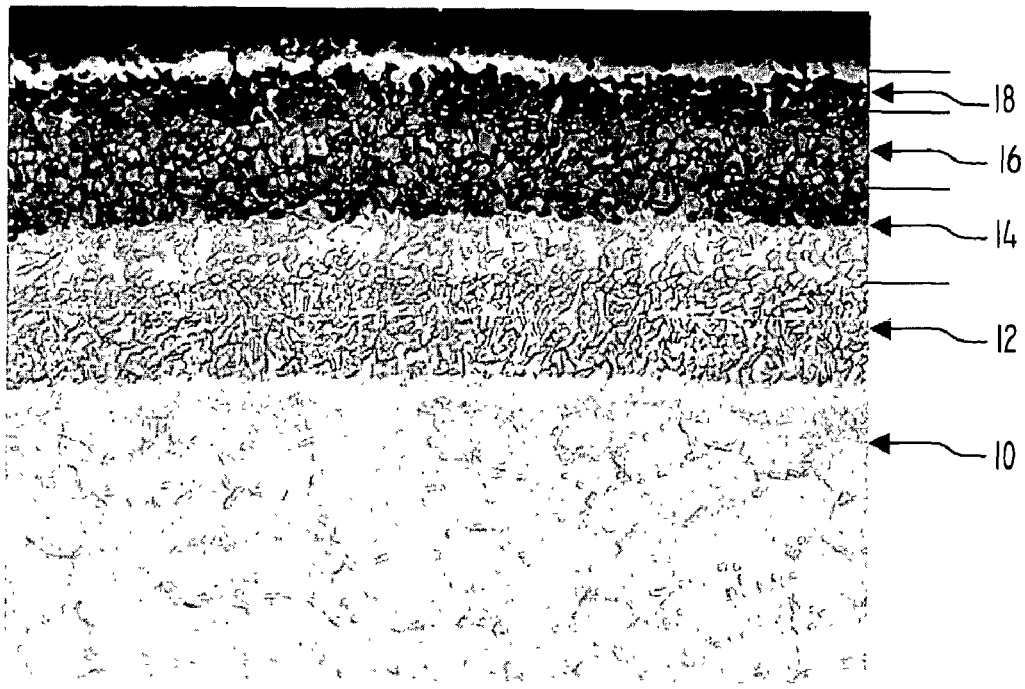
FIG. 1 is a scanned image of a micrograph of one embodiment of a corrosion-resistant layered coating having a CoCrAlY first layer overlaid with a diffused coating derived from a green coating composition containing platinum, silicon, chromium, and aluminum, which was prepared as discussed in Example 1 in accordance with this invention.

For the purposes of promoting an understanding of the principles of the invention, reference will now be made to preferred embodiments, and specific language will be used to describe the same. It will nevertheless be understood that no limitation of the scope of the invention is thereby intended. Any alterations and further modifications in the described processes, coated substrates, coatings, or compositions and any further applications of the principles of the invention as described herein are contemplated as would normally occur to one skilled in the art to which the invention relates.

In general this invention relates to coated substrates, coating systems, and methods for coating metallic articles with a multilayered coating system. The coating system and methods can be tailored to provide both hot corrosion protection and oxidation resistance. The system comprises an MCrAl(Y,Hf)-derived base coat, which can be deposited on a metallic article such as a turbine blade or other gas turbine component. By use of the term MCrAl(Y,Hf), it is to be understood that the alloy includes either yttrium, hafnium, or a mixture of these metals. The MCrAl(Y,Hf)-derived base coat can be overlaid with a green coating composition. The green coating composition can include a selected combination of desirable metals either as a prealloy powder or an alloy powder. The green coating composition can be selected to include one or more noble metals, such as Pt, Pd, Rh, Ru; one or more of Si, Al, Cr, Mn; and one or more a reactive metals such as Hf, La, and Y. Examples of suitable green coating compositions for use in the present invention are described in copending U.S. patent application Ser. No. 09/354,616 filed Jul. 16, 1999; now U.S. Pat. No. 6,406,561. The green coated article is then heat treated to diffuse the coating components and provide the multilayered, diffused coating system. In preferred embodiments, the coating system exhibits two or more zones or gradients having differing relative amounts of the alloy constituents.

In preferred embodiments, the present invention provides a diffused coating that resists oxidation and both Type 1 and Type 2 corrosion processes. While it is not intended to limit this invention or be bound by any theory of operation, it is thought that Type 1 and Type 2 corrosion processes occur through different mechanisms. For example, in Type 1 corrosion processes, which typically occur at a temperature level of about 900° C., it is thought that environmental sulfur and salts react with a MCrAl(Y,Hf)-type coating to form chromium sulfides, which deplete the chromium content in the coating and results in coating degradation. Eventually the underlying substrate can be exposed, which can then erode, oxidize, and/or corrode, For Type 2 corrosion processes, which occur at a temperature level of about 700° C., it is thought that salts fluxing in the material form one or more eutectic mixture(s) in the coating. The low melting eutectic mixture can subsequently flux or react with the substrate at about 700° C., causing the coating to prematurely wear away or otherwise be displaced, eventually exposing the substrate, which can then erode, oxidize, and/or corrode. The present invention provides a graded coating on a metallic substrate. More preferably, the present invention provides a coating system that includes intermediate layers and/or zones having differing coating compositions and which can resist either Type 1 or Type 2 or both corrosion processes.

The coating system of the present invention includes a base coat that is derived from a MCrAl(Y,Hf)-type coating composition. In the MCrAl(Y,Hf) coating, M can be selected from the metals, Co, Ni, Fe, and combinations thereof. In preferred embodiments, the MCrAl(Y,Hf) coating comprises a nominal composition, in weight percent based upon the total weight of the applied MCrAl(Y,Hf) coating: chromium in an amount of at least about 20%, more preferably at least about 30%, and less than about 40%, more preferably less than about 35%, still more preferably in the range of between 28% and 33%; aluminum in an amount of at least about 6%, more preferably at least about 9%, and less than about 15%, more preferably less than about 12%, still more preferably in the range of about 8% to about 12%; and a metal such as Y, Hf, La, or combinations of these metals, in an amount of at least about 0.3%, more preferably at least about 1%, and less than about 8%, more preferably less than about 2.5%, still more preferably in the range of 0.5% to 2.5%; M (Co, Ni, or Fe) is the balance of the MCrAl(Y, Hf) coating, not considering incidental or tramp impurities.

The MCrAl(Y,Hf)-derived coating can be applied directly to the substrate. Alternatively, the MCrAl(Y,Hf) can be applied to a bond coat or a subcoating, such as an aluminide coating (e.g. an aluminide coating, a platinum-aluminide coating, or a platinum-silicon-aluminide coating). The MCrAl(Y,Hf) coating can normally be applied over the external surface of the coated article. Furthermore, in certain applications for hollow components (e.g. turbine blades and vanes), it may be desirable to meet the demands on performance by depositing an internal aluminide coating with or without simultaneously coating the surfaces prior to or after depositing the MCrAl(Y,Hf) layers. Generally, the coating on the internal passages and external airfoil surfaces are applied by either slurry or gas phase or electrophoretic processes. In the case where platinum is present on the external surface, it is first applied by electroplating and is then overaluminized by the aforementioned procedure. The platinum-silicon-aluminide coating can be applied, as a single step, by the electrophoretic process.

The MCrAl(Y,Hf) coating can be applied using any techniques known or commonly used. Preferably the MCrAl (Y,Hf) coating is applied using a thermal spray technique, such as an electron beam physical vapor deposition (EB-PVD), argon shrouded plasma spray (ASPS), air plasma spraying (APS), high velocity oxyfuel (HVOF), low pressure plasma spray (LPPS), or electrodeposited (ECP) processes.

Typically, the MCrAl(Y,Hf) coating consists of two-phase $\beta$ and $\gamma$ structures, where $\beta$=(Ni,Co)Al, and $\gamma$ is a solid solution of Cr and Y in a Ni,Co (metal solution). It is generally, but not exclusively, applied to provide a coating between about 2 to 8 mils thick.

The green coating composition [i.e. the composition that is applied to the MCrAl(Y,Hf) coating layer before further heat treatment or other curing] comprises two or more powdered metals. All percentages listed herein are weight percentages unless specified otherwise. The nominal composition of metals in the green coating composition includes: between about 34% and about 95% Pt, Si in an amount not more than about 35%, up to about 72% Al, up to about 50% Cr, up to about 18% Mn, and up to about 10% of Hf, Y, and La or a mixture thereof.

More particularly describing the metals used in the green coating compositions, one embodiment employs between about 40% and about 80% (by weight of the total metal content) of a first powder comprising between about 85% and about 99.9% Pt and up to about 15% Si, and between about 20% and about 60% of a second powder. The second powder comprises between about 50% and about 75% Al and between about 25% and about 50% Cr. Optionally a third powder composition can be included. The third powder can comprise between about 95% and about 100% Al. Further, the green coating also can include a metal selected from Hf, Y, La, Mn or mixtures of these metals in a combined amount up to about 10%.

A second embodiment of the present invention employs between about 40% and about 80% of the same first powder comprising between about 85% and about 99.9% Pt and up to 15% Si, and between about 20% and about 60% of a second powder. The second powder for this embodiment comprises between about 50% and about 75% Al and between about 25% and about 50% Cr. Optionally a third powder comprising between about 95% and about 100% Al. Additionally, the green coating composition can include up to about 10% of a metal selected from Hf, Y, La, Mn or mixtures of these metals.

In a third embodiment of the present invention the green coating composition comprises between about 40% and about 80% of a first powder comprising 85–99.5% Pt and up to about 15% Si, and between about 20% and about 60% of a second powder. The second powder comprises between about 35% and about 45% Al, between about 35% and about 45% Cr, and between about 10% and about 30% Mn. Additionally, the green coating composition can include up to about 10% of a metal selected from Hf, Y, La, or mixtures of these metals.

A fourth embodiment includes 40–80% of the first powder comprising between about 85% and about 99.9% Pt and up to about 15% Si, and between about 20% and about 60% of a second powder comprising between about 35% and about 45% Al, between about 35% and about 45% Cr, and between about 10% and about 30% Mn. Optionally, the third and fourth embodiments can include up to about 40% of a third powder. The third powder can include between about 95% and about 100% Al. Additionally, the green coating composition can include up to about 10% of a metal selected from Hf, Y, La, or mixtures of these metals.

A fifth embodiment of the present invention includes a green coating composition that has only the first and third powders of the earlier embodiments and accordingly comprises 50–80% of a first powder comprising 85–99.5% Pt and 0–15% Si, and 20–50% of a second powder comprising 95–100% Al. Additionally, the green coating composition can include up to about 10% of a metal selected from Hf, Y, La, Mn or mixtures of these metals.

A sixth embodiment of the present invention uses a green coating composition that includes between about 95% and about 100% of a first powder comprising between about 85% and about 99.9% Pt and up to about 15% Si, and between about 0% and about 10% of a second powder comprising a metal selected from Hf, La, Mn, Y, or mixtures of these metals.

A seventh embodiment of the present invention comprises a green coating composition that includes about 90–100% of a first powder comprising between about 45% and about 55% aluminum, between about 25% and about 35% silicon, and between about 15% and about 25% chromium. In this embodiment, a second power is included in an amount of up to 10 wt %. The second powder for this embodiment can include between about 95% and about 100% Al. Additionally, the green coating composition can include up to about 10% of a metal selected from Hf, Y, La, Mn or mixtures of these metals.

An eighth embodiment of the present invention comprises a green coating composition that includes between about 95 to 100% of a first powder comprising between about 50 and 75% aluminum and between 20 and 50% chromium; and up to 5% of a second powder comprising between about 95 and 100% aluminum. Additionally, the green coating composition can include up to about 10% of a metal selected from Hf, Y, La, Mn or mixtures of these metals.

In alternative embodiments to each of those above described, a portion or all of the platinum in the first powder composition can be replaced by other noble metals; for example, palladium, ruthenium, and rhodium. A summary of the embodiments described above is shown in Table 1.

TABLE 1

| | Coating Compositions[2] | | | | |
|---|---|---|---|---|---|
| | | Aluminum-Bearing Component | | | |
| | Platinum-Bearing Powder | Aluminum Alloy or Prealloy Powder (wt %) | | | Aluminum |
| | (wt %)[1,3] 85–99.5 Pt, less than 15 Si | 50–75 Al 25–50 Cr | 35–45 Al 35–45 Cr 10–30 Mn | 45–55 Al 25–35 Si 15–25 Cr | Powder (wt %) 95–100 Al |
| 1 | 40–80 | 20–60 | — | — | — |
| 2 | 40–80 | 20–60 | — | — | Up to 40 |
| 3 | 40–80 | — | 20–60 | — | — |
| 4 | 40–80 | — | 20–60 | — | Up to 40 |
| 5 | 50–80 | — | — | — | 20–50 |
| 6 | 95–100 | — | — | — | — |
| 7 | — | — | — | 90–100 | Up to 10 |
| 8 | — | 95–100 | — | — | Up to 5 |

[1]A portion or all of the platinum can be replaced by other noble metals; for example, palladium, ruthenium, and rhodium.
[2]The coating compositions can include up to about 10% of Hf, Y, La, Mn, or mixtures thereof.
[3]Up to about 5% Cr.

As indicated above, the green coating composition may comprise about 40 to about 80 wt % (based on the weight of the metal used in the coating) of a platinum-bearing powder, most preferably a platinum, silicon containing powder. Preferably about 55 to about 70 wt % of the platinum-bearing powder is used. In addition, the green coating compositions include about 20–60% of an aluminum-bearing component comprising aluminum and chromium metal either as a mixture of metal powders or, preferably, an Al-Cr powdered alloy. Preferably the green coating composition includes about 30–45% of the aluminum-bearing component. The diffused platinum silicon enriched-aluminide coatings thus formed are generally high-temperature, oxidation-resistant coatings.

The platinum, silicon powder can be an intimate mixture of elemental platinum and silicon or it may be a powdered Pt—Si alloy. Preferably the platinum, silicon powder comprises about 85 to about 99.5 wt % platinum and silicon in an amount less than about 15 wt % silicon. Preferably silicon is included in an amount between about 0.5% and about 15%. More preferably the platinum, silicon component comprises between about 87 to about 97 wt % platinum and between about 3 to about 13 wt % silicon. Optionally, the platinum, silicon containing powder also can include up to about 5% Cr. In preferred embodiments, the resulting green coating composition can include between about 34% and about 80% Pt and Si in an amount no more than about 12%. Further, the platinum can be substituted by one or more noble metals.

The platinum-silicon alloy is preferably prepared by first mixing finely divided platinum powder with silicon powder at about 1 micron particle size, compacting the mixed powders into a pellet, and sintering the pellet in an argon atmosphere or other suitable protective atmosphere in a stepped-heat treatment. One such heat treatment includes sintering the pellet 1) at about 1,400° F. (760° C.) for 30 minutes, 2) at about 1,500° F. (815° C.) for about ten minutes, 3) at about 1,525° F. (843° C.) for about 30 minutes, 4) at about 1,800° F. (982° C.) for about 15 minutes, and then 5) at about 1,900° F. (1038° C.) for about 30 minutes.

The sintered pellet is then reduced to approximately an average particle size of about 325 mesh by pulverizing in a steel cylinder and pestle, and then ball milling the pulverized particles in a vehicle (typically, 60 wt % isopropanol and about 40 wt % nitromethane) for 10 to 30 hours under an inert atmosphere, such as argon, to produce a platinum-silicon alloy powder typically in the 1–10 micron particle size range. Such alloy powder may also be produced by other suitable methods known in the art, such as gas atomization.

As to the aluminum, chromium portion of the green coating compositions, the coatings preferably comprise about 20 to about 60 wt % (based on the weight of the metal used in the coating) of the aluminum, chromium containing prealloy or alloy powder. More preferably, the coating composition includes about 30 to about 45 wt % of the aluminum-chromium alloy. The aluminum-chromium alloy includes about 50 to about 75 wt % aluminum and about 25 to about 50 wt % chromium; more preferably, about 68 to about 72 wt % aluminum and about 28 to about 32 wt % chromium. In addition, the aluminum, chromium portion can include up to 35% silicon. In more preferred embodiments, the resulting green coating composition can include between about 10 and about 45 wt % aluminum and between about 5 and 30 wt % chromium.

The aluminum chromium alloy can be provided as an alloy powder prepared according to standard processes known in the art. Suitable aluminum-chromium alloys are commercially available. An aluminum-chromium alloy that includes about 55 wt % aluminum and about 45 wt % chromium is commercially available. The powdered alloy preferably has an average particle size of about 3 to about 10 microns.

Optionally, the coating composition using Pt, Si powder and Al, Cr powder can also include up to about 40 wt % of an additional aluminum-bearing component that includes aluminum powder. More preferably the coating composition includes about 2 to about 20 wt % of the additional aluminum-bearing component.

The additional aluminum-bearing component may consist essentially of aluminum metal powder. Alternatively, the additional aluminum-bearing component may comprise at least about 90 wt % aluminum metal and up to about 10 wt % of a metal selected from the group consisting of Hf, Y, La, Mn and mixtures thereof. The aluminum-bearing component can be an intimate mixture of metal powders or a powdered alloy. When an aluminum-bearing component is a powdered alloy, it is different in composition from the Al—Cr alloy powder discussed above.

In another preferred embodiment the green coating composition comprises about 40 to about 80 wt % of a platinum, silicon powder, more preferably about 55 to about 65 wt %, and about 20 to about 60 wt % of an aluminum-bearing component comprising Al, Cr and Mn metals either as a mixture of metal powders or, preferably, an Al—Cr—Mn powdered alloy. More preferably, the green coating composition includes about 35 to about 45 wt % of the aluminum-bearing component comprising Al, Cr and Mn. The diffused platinum-silicon-manganese-enriched coatings thus formed generally are highly corrosion-resistant coatings.

As with the previous embodiments, the platinum, silicon powder is preferably a powdered alloy; although, an intimate mixture of the platinum and silicon metals can be used in this invention. The preferred composition of the platinum, silicon powder is as described above. In more preferred embodiments, the resulting green coating composition can include between about between about 34 wt % and about 80 wt % Pt and Si in an amount no more than about 12 wt %.

The Al, Cr, Mn component is also generally as described above, although the addition of manganese makes the preferred amounts of the various metals somewhat different. In this embodiment, the aluminum alloy includes about 35 to about 45 wt % aluminum, about 35 to about 45 wt % chromium, and about 10 to about 30 wt % manganese, with about 38 to about 44 wt % aluminum, about 38 to about 42 wt % chromium, and about 16 to about 22 wt % manganese being more preferred. In more preferred embodiments, the resulting green coating composition can include between about 7% and about 27% aluminum, about 7 wt % to about 27 wt % chromium, and between about 2% to about 18 wt % manganese.

The aluminum-chromium-manganese alloy can be provided as an alloy powder prepared according to standard processes known in the art and is commercially available. The commercially-prepared powdered alloy has an average particle size of about 3 to about 10 microns.

As with the case of the Pt, Si/Al, Cr powder combinations, the Pt, Si/Al, Cr, Mn component may also include up to about 40 wt % of an additional aluminum-bearing component that includes aluminum powder. More preferably, about 5 to about 20 wt % of the additional aluminum-bearing component is used.

Also as above, the aluminum-bearing component may consist essentially of aluminum metal powder. Alternatively, the aluminum-bearing component can include greater than 90 wt % aluminum metal and up to about 10 wt % of a metal selected from the group consisting of Hf, Y, La, Mn, and mixtures thereof. The aluminum-bearing component can be an intimate mixture of metal powders or a powdered alloy. The aluminum-bearing component can be prepared by standardized processes well-known in the art, with the aluminum preferably being provided in powder form with a particle size of about 1 to about 10 microns.

This coating composition provides a highly corrosion-resistant coating for nickel- and cobalt-based alloys. However, this coating finds particular advantages when used for nickel-based alloys.

In another preferred embodiment of this invention, the green coating composition comprises about 50 to about 80 wt % of a platinum, silicon powder and about 20 to about 50 wt % of an aluminum-bearing component. More preferably the coating composition comprises about 60 to about 72 wt % of the platinum, silicon powder and about 28 to about 40 wt % of the aluminum-bearing component. In a more preferred embodiment, the green coating composition can include between about 42.5 and about 80 wt % platinum, and silicon in an amount not more than about 12 wt %.

The platinum, silicon powder is as described above.

The aluminum-bearing component may consist essentially of aluminum metal powder. Alternatively, the aluminum-bearing component comprises greater than 90 wt % aluminum metal and up to about 10 wt % of a metal selected from the group consisting of Hf, Y, La, Mn, and mixtures thereof. The aluminum-bearing component is prepared as described above.

This coating composition can be heat treated to form a platinum-aluminide coating that exhibits high temperature oxidation resistance for both nickel- and cobalt-based alloys.

In still yet another embodiment, the green coating composition comprises about 95 to about 100 wt % of the platinum, silicon powder and up to 5 wt % Cr. Consequently, the green coating composition can include a metallic coating component consisting essentially of a platinum, silicon powder and optionally Cr. As noted above, the platinum, silicon powder can be an intimate mixture of elemental platinum and silicon or it can be a powdered Pt—Si alloy.

In still another embodiment, the green coating composition comprises about 90 to about 100 wt % of an aluminum, silicon, chromium powder. The aluminum, silicon, chromium powder can be an intimate mixture of elemental aluminum, silicon, and chromium or it can be a powdered alloy of two or three of these metals. In a preferred embodiment, the green coating composition comprises a powdered Al—Cr alloy combined with free, powdered silicon. Preferably the aluminum, silicon, chromium powder comprises about 45 to about 55 wt % aluminum, about 25 to about 35 wt % silicon, and about 15 to about 25 wt % chromium; more preferably, about 48 to about 52 wt % aluminum, about 28 to about 32 wt % silicon, and about 18 to about 22 wt % chromium. In preferred embodiments, the green coating composition can include between about 43 and about 55 wt % aluminum, between about 24 and about 35 wt % silicon and between about 14 and about 25 wt % chromium. Optionally, the green coating composition can include an aluminum-bearing component that consists essentially of aluminum metal powder. Alternatively, the aluminum-bearing component comprises greater than 90 wt % aluminum metal and up to about 10 wt % of a metal selected from the group consisting of Hf, Y, La, Mn, and mixtures thereof. The aluminum-bearing component is prepared as described above.

In still yet another embodiment, the green coating composition comprises about 95–100 wt % of an aluminum, chromium powder. The aluminum, chromium powder can include between about 50 to 75 wt % Al and about 25 to 50 wt % chromium; more preferably, between about 68 to about 72 wt % aluminum and about 28 to about 32 wt % chromium. The aluminum, chromium powder can be an intimate mixture of elemental aluminum and chromium metal or a powdered alloy of aluminum and chromium. Optionally, this green coating composition can include up to 5 wt % of an aluminum powder composition above that included in the first aluminum, chromium powder. Further, the aluminum powder composition can include up to about 10 wt % of Hf, Y, La, Mn, or mixtures thereof. In more preferred embodiments, the resulting green coating composition can include between about 47.5 and about 74 wt % aluminum and between about 24 and about 50 wt % chromium.

In certain preferred embodiments, the non-diffused coating composition also includes one or more additional metallic materials to modify the physical and chemical properties of the coated substrate. Examples of metallic materials that can be included in the coating composition include: Y, Hf, La, as well as and other noble metals (e.g., Pd, Rh, and Ru and mixtures thereof). In other embodiments, the coating compositions can be provided substantially free of halogens, e.g., $Cl^-$, $Br^-$, and $F^-$ containing salts. Further, in selected embodiments the above compositions can also be provided to prevent formation of rhenium rich precipitates in rhenium containing alloys. By use of the term "substantially free", it is intended to mean that these components are not intentionally added to the compositions specified. It should also be understood that the above compositions describe the nominal compositions and that in use, because of processing limitations, the compositions can include one or more incidental elements that are not intentionally added.

Heat treating the non-diffused coating can interdiffuse the components from the underlying first coating. The MCrAlY coating and the components from the green coating composition to provide one or more diffused coatings or layers. Further, the diffused layers can include one or more intermediate layers. The two adjacent intermediate layers can be the same or different components. If the adjacent intermediate layers include some of the same components, the relative amounts of the components can differ between the two adjacent layers. In one embodiment, the coated article of the present invention includes a first diffused coating and a second diffused coating overlaying the first coating. The first diffused coating is deposited on the article's surface and includes a diffused coating derived from the MCrAl(Y,Hf). The second diffused coating is derived at least partly from the green coating composition. The second layer comprises a plurality of intermediate layers including a first intermediate layer comprising, in weight percent, about 2% to about 18% Al, about 14% to about 36% Cr, and about 50% to about 68% Co.

In other embodiments, the second layer can include a second intermediate layer in addition to the first intermediate layer. The second intermediate layer can include, in weight percent, about 6% to about 23% Al, about 26% to about 39% Cr, and about 26% to about 67% Co. In other embodiments, the intermediate layer can also include, in wt %, about 6% to about 12% Si, and optionally, about 2% to about 14% Pt.

The second layer can also include a third intermediate layer. The third intermediate layer can comprise, in weight percent, about 3% to about 24% Al, about 4% to about 37% Cr, about 8% to about 67% Co, up to about 7% Si, and up to about 76% Pt. In still other embodiments, the second layer can include a fourth intermediate layer. The fourth intermediate layer can include, in weight percent, about 14% to about 20% Al, about 2% to about 34% Pt, about 1% to about 5% Si, about 10% to about 23% Cr, and about 25% to about 51% Co. In selected embodiments, the intermediate layers are clearly distinguishable and visible from a micrograph of the coated article. In other embodiments, intermediate layers exhibit different compositional constituents and or different relative ratios of constituents. In still yet other embodiments, the intermediate layer includes the same or different constituents in differing phases.

It should be understood by those skilled in the art that the first layer and the second layer can interdiffuse. In this embodiment, it will be understood that the interface between the first layer and the second layer is an interdiffusion zone that can vary in width. Additionally, the intermediate layers in the first or second layer can also be interdiffused layers.

The coating compositions of the present invention can be applied to the surface of a wide variety of substrates, with nickel- or cobalt-based alloy substrates being most preferred. Examples of alloys that can be protected with the layered coatings according to the present invention include, but are not limited to: nickel-based alloys such as IN738, IN792, Mar-M246, Mar-M247; DS Mar-M247; single crystal nickel alloys such as CMSX-3, CMSX-4, CMSX-10, or CM186; and cobalt-based alloys such as Mar-M509 and X40, all of which are known to those in the art.

The substrate is cleaned using methods commonly used in the art. For example, the substrate surface can be washed or wiped with an organic solvent to remove any grease. Then the substrate surface can be abrasively cleaned to remove surface oxides and/or grit blasted with $Al_2O_3$ particles (~220 mesh). If necessary, the surface can be cleaned to remove any remaining grease, oil, or dust prior to being coated. Preferably the MCrAl(Y,Hf) coating is applied using a thermal spray technique, such as an electron beam physical vapor deposition (EB-PVD), argon shrouded plasma spray (ASPS), air plasma spraying (APS), high velocity oxyfuel (HVOF), low pressure plasma spray (LPPS) process, or electrodeposited MCrAl(Y,Hf).

Regardless of the number or composition of the various powders used to make the coating composition, the coating may be applied to the MCrAl(Y,Hf) coating using a variety of application methods known to the art. These include dipping, spraying, slurry deposition, electrophoretic, and the like to provide a green coating on the substrate (i.e., the composition that is applied to the MCrAl(Y,Hf) coating—before heat treatment or other curing).

Typically, the green coating composition is suspended in a vehicle to form a slurry, which is applied in a single application onto the surface of the MCrAl(Y,Hf) coating to provide a single, homogeneous, non-diffused coating. Preferred application methods include electrophoretically depositing or painting the slurry onto the substrate surface.

The green coating composition can be electrophoretically deposited on the MCrAl(Y,Hf) coating after first degreasing the coating and then dry-honing the cleaned substrate using 220 or 240 mesh aluminum oxide particles. The electrophoretic deposition step is carried out in an electrophoretic bath that includes a vehicle, zein, cobalt nitrate hexahydrate and the desired metallic powders. A sample electrophoretic bath contains:

(A) vehicle comprising: 60±5% by weight isopropanol, 40±5% nitromethane;

(B) metallic powder: 20 to 45 grams total coating composition per liter of vehicle;

(C) zein: 1.0 to 3.0 grams zein per liter of vehicle; and (D) cobalt nitrate hexahydrate: 0.10 to 0.20 grams per liter of vehicle.

To effect electrophoretic deposition from the bath onto the nickel- or cobalt-based alloy substrates, the coated substrate is immersed in the electrophoretic bath and connected in a direct current electrical circuit as a cathode. A metallic strip, for example, stainless steel, nickel or other conductive metal, is used as the anode and is immersed in the bath adjacent to the alloy substrate (cathode).

A current density of about 1 to about 2 mA/cm$^2$ is applied between the substrate (cathode) and the metallic strip (anode) for a time of about 1 to 4 minutes, while the bath is stirred to keep the desired metallic powders in suspension and, preferably, maintained at room temperature. During this time, a mixture of platinum, silicon powder and the aluminum-containing alloy, the aluminum, silicon powder, and/or the aluminum-bearing component are deposited as a homogenous, uniform-thickness powder deposit on the substrate surface.

The coated substrate is then removed from the electrophoretic bath and air dried to evaporate any residual solvent. The weight of the dry coating deposited on the substrate is optimally about 30 to about 65 mg/cm$^2$, although coating weights from about 10 to about 70 mg/cm are suitable, depending on the particular green coating composition.

The coating composition also can be applied by a slurry deposition method to the substrate. Typically the slurry is applied by spraying, dipping, or painting the substrate to provide a smooth, homogenous, and uniformly thick coating on the substrate. Good results are obtained when the coating is painted using a soft bristle brush.

The slurry preferably contains a mixture of isopropanol and nitromethane in a 60:40 weight ratio to suspend the powdered coating composition. However, it is understood that other vehicles that do not inhibit formation of the aluminide diffusion coating may also be used.

Most preferably, the selected vehicle maintains the metallic and alloy powders in suspension and has sufficient volatility to permit rapid drying of the coated substrate.

Typically, the slurry contains zein (about 30 g per liter of vehicle) and about 500 to about 1000 g of the coating composition per liter of vehicle. The concentration of the coating composition and/or zein can be varied to provide a uniform coating having an optimum coverage using a brush, a spray gun or other application equipment and methods.

It is to be appreciated from the above that the green coating composition is preferably a homogeneous mixture of the coating materials. In the preferred commercial embodiments, the green coating composition is prepared by mixing the various materials together before applying the coating.

The coated substrate is then heated by increasing the temperature at a controlled rate or, more preferably, via a multi-stage heating process to form the diffused coating including a noble metal-aluminide, a silicon-aluminide coating, and/or a noble metal-silicon coating. The process provides the advantage of being operable at significantly reduced cost and effort when compared with conventional coating techniques.

As indicated above, the heat treatment preferably uses a sequential, multi-stage heating process to diffuse the powdered coating compositions into the substrate. In the first heating stage, the powdered metal is preferably heated until it forms a transient liquid phase on the metal substrate. To accomplish that, it is generally preferred to first heat the coated substrate to a temperature of about 900–1,600° F. (482–871° C.) for about 0.25 to 2 hours. More preferably, the non-diffused coated substrate is subjected to a first heat diffusion treatment of about 1,100° F. to about 1,400° F. (593–760° C.) for about 0.25 hours to about 2 hours.

In the second heating stage, the coated substrate is heated sufficiently to diffuse the coating into the substrate. Typically, the temperature is raised from the first stage to the second stage in the furnace. Generally, a temperature of about 1,600–2,100° F. (480–1150° C.) and a heating time of one to eight hours is effective for that stage. More preferably, the second heating stage uses a temperature of about 1,850° F. to about 2,080° F. (1010–1140° C.) and a time of about one to eight hours.

In some preferred embodiments, it is advantageous to use a pretreatment heating step as part of, or before, the first heating stage. With this method, the first heating stage is preferably accomplished by heating the coated substrate to a first temperature of about 950° F. to about 1,150° F. (510–620° C.) for about 0.5 to about 1.0 hours.

It is to be appreciated that the multiple heating stages may be accomplished by "ramping" the temperature upward from the lower heat treatment temperature to the higher heat treatment temperature. With that technique, there may be no clear break between the first heating stage and the second heating stage, as the two stages run smoothly into each other.

The diffusion heat treatment is preferably accomplished in vacuum, hydrogen, argon, or other suitable furnace atmosphere.

In one preferred embodiment, the green coated substrate is subjected to a pre-diffusion temperature of about 950° F. to about 1,150° F. (510–620° C.) for 0.5 to about 1 hour. Thereafter, the coated substrate is heated to about 1,200° F. to about 1,400° F. (650–760° C.) for about 1 hour and then to about 1,900° F. to about 1,975° F. (1040–1080° C.) f about 1 to about 8 hours. In another preferred embodiment, the diffused platinum-aluminide coating is formed by heating the non-diffusion coated substrate up to a temperature of about 900° F. (480° C.), and thereafter heating the coated substrate up to a temperature of about 1,400° F. (760° C.) by judicious selection of a carefully controlled temperature ramp rate, followed by a higher temperature hold at about 1,900° F. to 2,100° F. (1040–1150° C.) for about 1 to about 8 hours.

Preferably the green coated substrate is subjected to a stepped heat treatment comprising heating the coated substrate to a temperature between about 1900° F. and about 1975° F. (1040–1080° C.). Specific examples include a three step heat treatment of one hour at about 1100° F. (593° C.), about one hour at about 1225° F. (623° C.), and about 8 hours at about 1925° F. (1052° C.). The preferred heat treatment provides a chromium enriched zone or intermediate layer positioned proximate to the interface between the MCrAl(Y,Hf) and additive Pt, Al, Si rich, overcoat layer.

The second layer can be overlaid with an aluminum coating material as an optional third layer. Such a process is commonly referred to as overaluminizing. The aluminum overcoating can be applied by pack cementation, sputtering or ion vapor deposition techniques, gas phase deposition techniques, and electrophoretic deposition. For example, the second layer can be coated with a third layer comprising either an aluminide coating, a chromium-aluminide coating, a platinum-aluminide coating, or a platinum-silicon-aluminide coating.

While not intending to be bound by any theory, it is thought that the aluminum in the aluminum-bearing material (s) melts and all other components in the coating composition interdiffuse in the molten aluminum. After sufficient time to interdiffuse the components of the coating composition, the coated substrate is heated to a second temperature, higher than the first temperature, to diffuse the coating composition into the substrate.

For the purpose of promoting further understanding and appreciation of the present invention and its advantages, the following Examples are provided. It will be understood, however, that these Examples are for illustrative purposes only and are not intended to limit the scope of the claimed invention.

EXAMPLE 1

A cobalt-alloy based coupon designated as Mar-M509 was cleaned by dry honing with 220 mesh $Al_2O_3$ particles. A base coating of CoCrAlY (nominal composition of 26% Cr, 9% Al, 0.5% Y and the balance Co and incidental impurities) was applied using an EB-PVD coating technique. This coating was further heat treated at 1975° F. (1080° C.) for 4 hours under vacuum and ceramic bead peened to provide the CoCrAlY-coated coupon.

A green coating composition comprised of about 30 g/l of a mixture in weight percent based upon the total weight of the metals in the slurry composition of 54% Pt, 6% Si, 31% Al and 9% Cr was suspended in a vehicle comprising about 60±5 wt % isopropanol and about 40±5 wt % nitromethane and zein (2.2 g/l) and cobalt nitrate hexahydrate (about 0.14 g/l). After the coating composition was electrophoretically deposited on the coupon, the coupon was air dried to evaporate the residual solvent. The resulting green coated coupon was subjected to a stepped heat treatment that included heating the coupon in a vacuum to a first hold temperature of about 1100° F. (593° C.) for about 1 hour, then to a second hold temperature of about 1225° F. (663° C.) for about 1 hour and then to a third hold temperature of about 1925° F. (1051° C.) for about 8 hours to form the diffused layered coating.

The coated coupon was removed from the furnace and allowed to cool to room temperature. The coated coupon was lightly cleaned by dry honing with 220 mesh aluminum oxide.

FIG. 1 is a scanned image of a micrograph of the diffused, layered coating of Example 1. As can be seen from micrograph, the diffused coating is typically about 3–4 mils thick. The cobalt-based alloy substrate denoted by 10 is overlaid with a layered coating system. An intermediate layer 12 contains about 2–6 wt % Al, about 24–28 wt % Cr, and about 63–66 wt % Co. The next intermediate layer 14 contains about 6–9 wt % Al, about 33–39 wt % Cr, and 48–57 wt % Co. The next intermediate layer 16 includes 18–24 wt % Al, 0–3 wt % Pt, 1–5 wt % Si, about 8–27 wt % Cr, and 50–67 wt % Co. The surface layer 18 includes about 20 wt % Al, about 25 wt % Pt, 2–5 wt % Si, about 12 wt % Cr, and about 25 wt % Co. The compositions of these layers were determined using SEM/probe analysis. Intermediate layer 14 exhibits a Cr enriched zone having a greater chromium content than the underlying CoCrAlY derived intermediate layer 12 or the upper intermediate layers 16 and 18. Furthermore, the enriched Cr zone has a greater chromium content then either of MCrAl(Y,Hf) alloy or the green coating composition used to form the diffused coating(s).

EXAMPLE 2

A cobalt-alloy based coupon designated as Mar-M509 was cleaned and prepared as described above in Example 1. A base coating of CoCrAlY (nominal composition of 26% Cr, 9% Al, 0.5% Y and the balance Co and incidental impurities) was applied using an EB-PVD coating technique. This coating was further heat-treated by 1975° F. for 4 hr and cleaned by ceramic bead peening to provide the CoCrAlY coated coupon.

The base CoCrAlY coating was coated with the same green coating composition described for Example 1 above. The resulting green coated coupon was subjected to a stepped heat treatment that included heating the coupon in a vacuum to a first hold temperature of about 1100° F. (593° C.) for about 1 hour, then to a second hold temperature of about 1225° F. (663° C.) for about 1 hour, and then to a third hold temperature of about 1975° F. (1051° C.) for about 4 hours to form the diffused layered coating.

The coated coupon was removed from the furnace and allowed to cool to room temperature. The coated coupon was lightly cleaned by dry honing with 220 mesh aluminum oxide.

Figure 2:
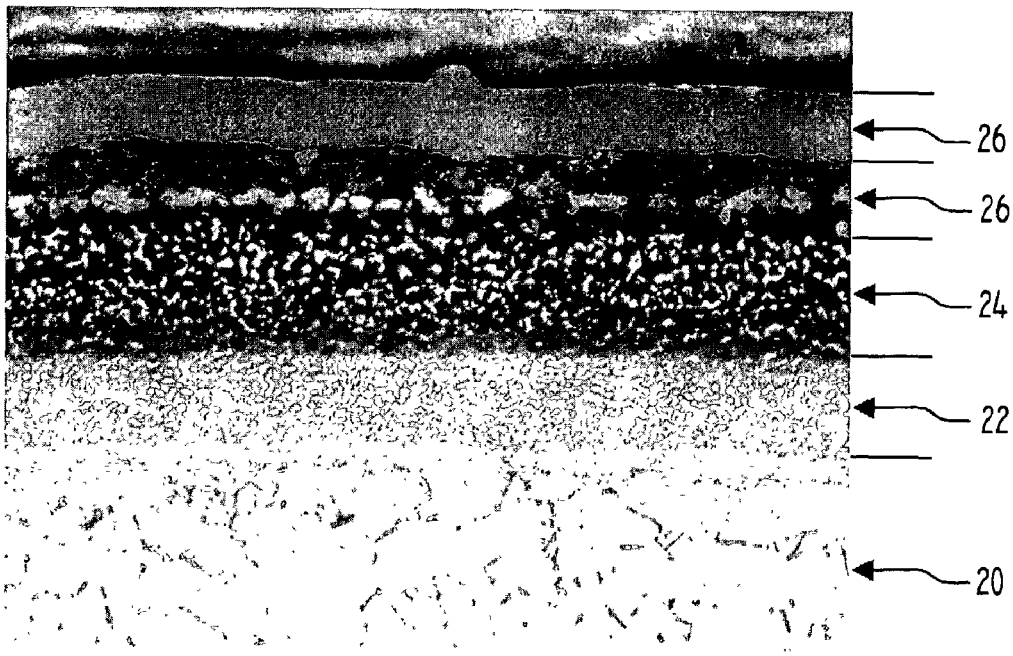
FIG. 2 is a scanned image of a micrograph of one embodiment of a corrosion-resistant layered coating having a CoCrAlY first layer overlaid with a diffused coating derived from a green coating composition containing platinum, silicon, chromium, and aluminum, which was prepared as discussed in Example 2 in accordance with this invention.

FIG. 2 is a scanned image of a micrograph of the, diffused, layered coating of Example 2. As can be seen from micrograph, the diffused coating is typically about 3.0 mils thick. The cobalt-based alloy substrate 20 is overlaid with a layer coating derived from the CoCrAlY and the green coating composition. A first intermediate layer 22 contains about 15–18 wt % Al, 1–5 wt % Si, about 14–20 wt % Cr, and 52–67 wt % Co. Intermediate layer 24 contains about 11–15 wt % Al, 6–12 wt % Si, 2–14 wt % Pt, about 36–40 wt % Cr, and about 26–56 wt % Co. The next intermediate layer 26 includes about 14–22 wt % Al, 0–7 wt % Si, 31–59 wt % Pt, about 8–37 wt % Cr, and about 8–17 wt % Co. Layer 28 is a metallographic nickel plate The composition of the coating system was determined using EDS microprobe.

EXAMPLE 3

A cobalt-alloy based coupon designated as Mar-M509 was cleaned and prepared as described above in Example 1. A base coating of CoCrAlY (nominal composition of 26% Cr, 9% Al, 0.5% Y and the balance Co and incidental impurities) was applied using an EB-PVD coating technique. This coating was further heat treated at 1975° F. (1080° C.) for 4 hours and ceramic bead-peened to provide the CoCrAlY coated coupon.

A green coating composition comprised of about 30 g/l of a mixture in weight percent based upon the total weight of the metals in the slurry composition of 90% Pt, 10 wt % Si, and zein (2.2 g/l) was suspended in a vehicle comprising about 60±5 wt % isopropanol and about 40±5 wt % nitromethane and zein (2.2 g/l) and cobalt nitrate hexahydrate (about 0.14 g/l). After the coating composition was electrophoretically deposited on the coupon, the coupon was air dried to evaporate the residual solvent. The resulting green coated coupon was subjected to a heat treatment that included heating the coupon in a vacuum to a temperature of about 1900° F. (~1040° C.) for about 1 hour to form the diffused layered coating.

The coated coupon was removed from the furnace and allowed to cool to room temperature. The coated coupon was lightly cleaned by dry honing with 220 mesh aluminum oxide.

Figure 3:
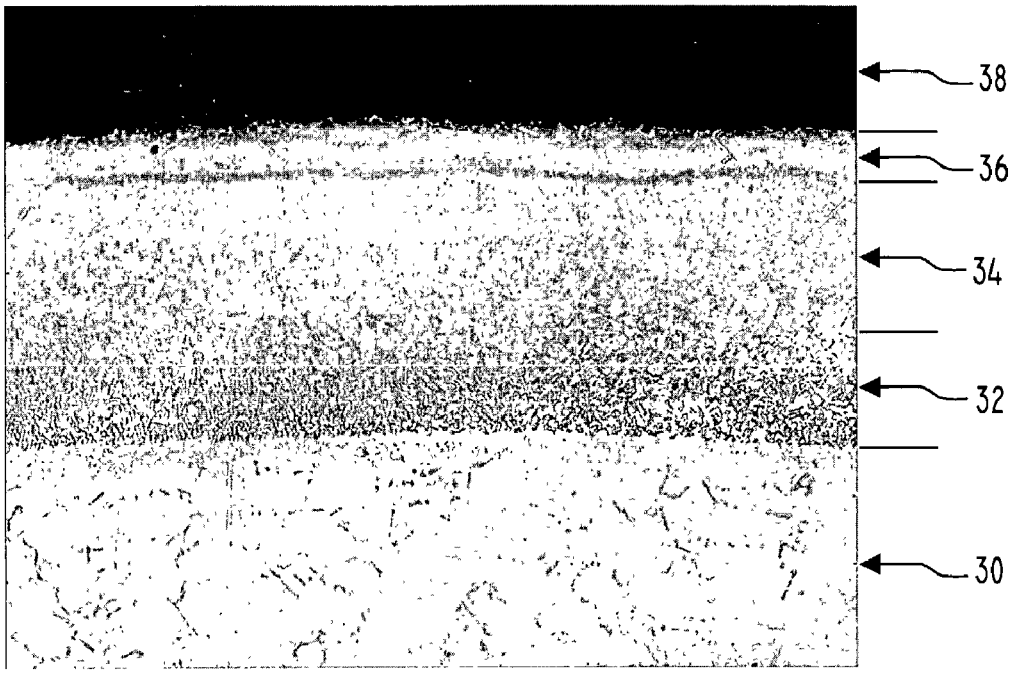
FIG. 3 is a scanned image of a micrograph of one embodiment of a corrosion-resistant layered coating having a CoCrAlY first layer overlaid with a diffused coating derived from a green coating composition containing platinum and silicon, which was prepared as discussed in Example 3 in accordance with this invention.

FIG. 3 shows a scanned image of a micrograph of the, diffused, layered coating of Example 3. As can be seen from micrograph, the diffused coating is typically about 3.0 mils thick. The cobalt-based alloy substrate 30 is overlaid with a layered coating. A first intermediate layer 32 contains about 2–6 wt % Al, about 23–27 wt % Cr, and about 60–66 wt % Co. The next intermediate layer 34 contains about 6–7 wt % Al, about 26–30 wt % Cr, and about 63–66 wt % Co. The surface layer 36 includes about 3–9 wt % Al, about 1–3 wt % Si, about 24–76 wt % Pt, about 5–20 wt % Cr, and 9–49 wt % Co. Layer 38 is a BAKELITE mounting material. The composition of the layered coating was determined using EDS microprobe.

EXAMPLE 4

A cobalt-alloy based coupon designated as Mar-M509 was cleaned and prepared as described above in Example 1. A base coating of CoCrAlHf (nominal composition of 26% Cr, 10.5% Al, 2.5% Hf, and the balance Co (and incidental impurities) was applied using an a low pressure plasma spray (LPPS) coating technique. This coating was further heat treated at 1975° F. (1080° C.) for 4 hours in vacuum then and cleaned by ceramic bead peening to provide the CoCrAlHf-coated coupon.

A green coating composition comprised of about 30 g/ml of a mixture in weight percent based upon the total weight of the metals in the slurry composition of 54 wt % Pt, 6 wt % Si, 31 wt % Al and about 9 wt % Cr. The metal powders were suspended in a vehicle comprising about 60±5 wt % isopropanol and about 40±5 wt % nitromethane and zein (2.2 g/L) and cobalt nitrate hexahydrate (about 0.14 g/L). After the coating composition was electrophoretically deposited on the coupon, the coupon was air dried to evaporate the residual solvent. The resulting green coated coupon was subjected to a stepped heat treatment that included heating the coupon in a vacuum to a first hold temperature of about 1100° F. (593° C.) for about 1 hour, then to a second hold temperature of about 1225° F. (663° C.) for about 1 hour, and then to a third hold temperature of about 1925° F. (1051° C.) for about 8 hours to form the diffused layered coating.

The coated coupon was removed from the furnace and allowed to cool to room temperature. The coated coupon was lightly cleaned by dry honing with 220 mesh aluminum oxide.

Figure 4:
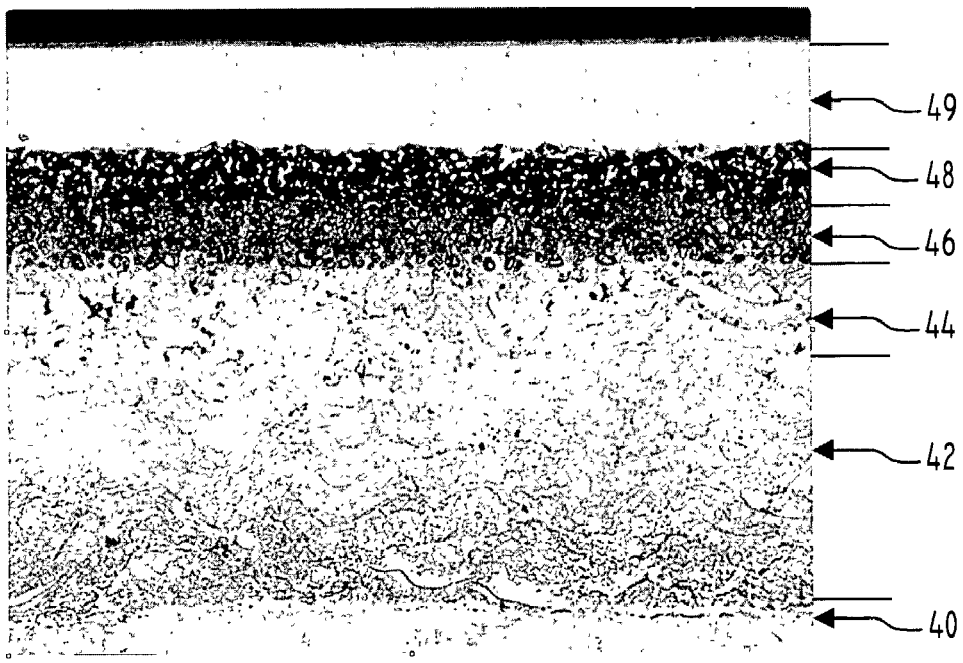
FIG. 4 is a scanned image of a micrograph of one embodiment of a corrosion-resistant layered coating having a CoCrAlHf first layer overlaid with a diffused coating derived from a green coating composition containing platinum, silicon, chromium, and aluminum, which was prepared as discussed in Example 4 in accordance with this invention.

FIG. 4 shows a scanned image of a micrograph of the, diffused, layered coating of Example 4. As can be seen from micrograph, the diffused coating is typically about 5.0 mils thick. The cobalt-based alloy substrate 40 is overlaid with a multilayered coating. A first intermediate layer 42 contains about 3–11 wt % Al, about 23–34 wt % Cr, and about 59–68 wt % Co. The next intermediate layer 44 contains about 7–9 wt % Al, about 35–36 wt % Cr, and about 53 wt % Co. The next intermediate layer 46 includes about 11–17 wt % Al, 0–5 wt % Si, about 14–26 wt % Cr, and about 53–66 wt % Co. The surface layer 48 includes about 14–16 wt % Al, 2–4 wt % Pt, 3–5 wt % Si, 20–23 wt % Cr, and 47–53 wt % Co. Layer 49 is a nickel plate material. The composition of the layered coating was determined using EDS microprobe techniques.

EXAMPLE 5

A cobalt-alloy based coupon designated as Mar-M509 was cleaned and prepared as described above in Example 1. A base coating of CoCrAlY (nominal composition of 26% Cr, 9% Al, 0.5% Y and the balance Co (and incidental impurities)) was applied using an EB-PVD coating technique. This coating was further heat treated at 1975° F. (1080° C.) then and cleaned by ceramic bead peened to provide the CoCrAlY coated coupon.

A green coating composition comprised of about 30 g/ml of a mixture in weight percent based upon the total weight of the metals in the slurry composition of 49 wt % Al, about 21 wt % Cr, about 30 wt % Si. The metal powders were suspended in a vehicle comprising about 60±5 wt % isopropanol and about 40±5 wt % nitromethane and zein (2.2 g/L) and cobalt nitrate hexahydrate (about 0.14 g/L). After the coating composition was electrophoretically deposited on the coupon, the coupon was air dried to evaporate the residual solvent. The resulting green coated coupon was subjected to a stepped heat treatment that included heating the coupon in a vacuum to a first hold temperature of about 1100° F. (593° C.) for about 1 hour, then to a second hold temperature of about 1225° F. (663° C.) for about 1 hour, and then to a third hold temperature of about 1925° F. (1051° C.) for about 4 hours in vacuum to form the diffused layered coating.

The coated coupon was removed from the furnace and allowed to cool to room temperature. The coated coupon was lightly cleaned by dry honing with 220 mesh aluminum oxide.

Figure 5:
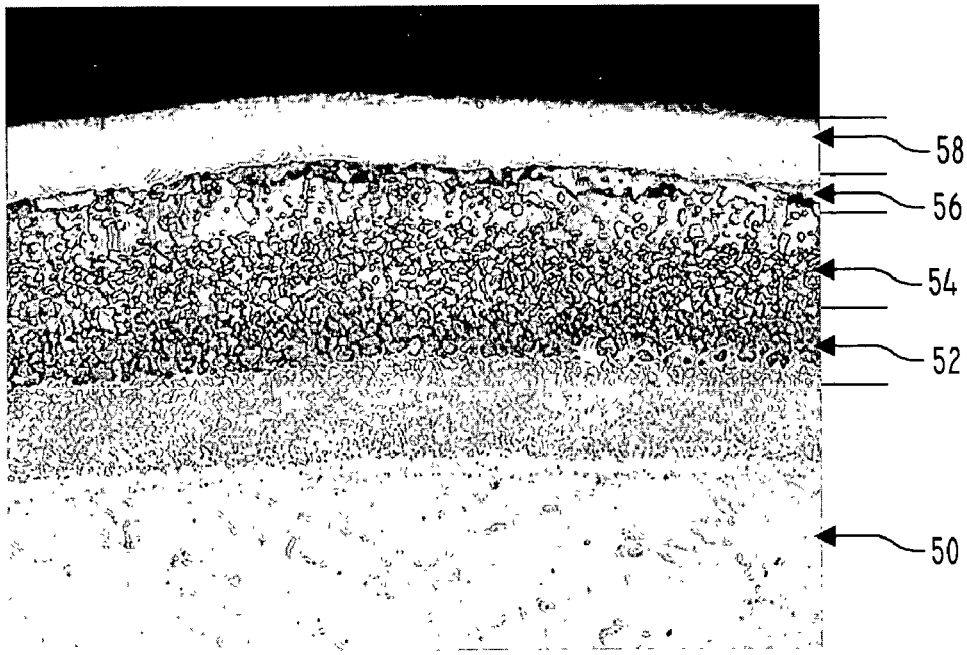
FIG. 5 is a scanned image of a micrograph of one embodiment of a corrosion-resistant layered coating having a CoCrAlY first layer overlaid with a diffused coating derived from a green coating composition containing, silicon, chromium, and aluminum, which was prepared as discussed in Example 5 in accordance with this invention.

FIG. 5 shows a scanned image of a micrograph of the, diffused, layered coating of Example 5. As can be seen from micrograph, the diffused coating is typically about 3.0 mils thick. The cobalt-based alloy substrate 50 is overlaid with a multilayered coating. A first intermediate layer 52 contains about 6–10 wt % Al, 0–1 wt % Si, 26–36 wt % Cr and 51–63 wt % Co. The intermediate layer 54 contains about 19–23 wt % Al, 3–7 wt % Si, and 11–24 wt % Cr and 47–66 wt % Co. The next surface layer 56 includes about 13 wt % Al, about 13 wt % Si, about 36 wt % Cr, and about 36 wt % Co. Layer 58 is a nickel plate material. The composition of the layered coating was determined using EDS microprobe techniques.

EXAMPLE 6

A cobalt-alloy based coupon designated as Mar-M509 was cleaned and prepared as described above in Example 1. A base coating of CoCrAlY (nominal composition of 26% Cr, 9% Al, 0.5% Y and the balance Co (and incidental impurities) was applied using an EB-PVD coating technique. This coating was further heat treated at 1975° F. (1080° C.) then and cleaned by ceramic bead peened to provide the CoCrAlY-coated coupon.

A green coating composition comprised of about 30 g/ml of a mixture in weight percent based upon the total weight of the metals in the slurry composition of 90 wt % Pt and about 10 wt % Si. The metal powders were suspended in a vehicle comprising about 60±5 wt % isopropanol and about 40±5 wt % nitromethane and zein (2.2 g/L) and cobalt nitrate hexahydrate (about 0.14 g/L). After the coating composition was electrophoretically deposited on the coupon, the coupon was air dried to evaporate the residual solvent. The resulting green coated coupon was subjected to a furnace heat treatment that included heating the coupon in a vacuum to a temperature of about 1900° F. (1038° C.) for about 1 hour. Upon removal of the coupon from the furnace, it was lightly cleaned by dry honing with 220 mesh $Al_2O_3$. A second green coating was applied having a nominal composition of about 70 wt % aluminum and about 30 wt % chromium. The resulting green coated coupon was subjected to a stepped heat treatment that included heating the coupon in a vacuum to a first hold temperature of about 1100° F. (593° C.) for about 1 hour, then to a second hold temperature of about 1225° F. (663° C.) for about 1 hour, and then to a third hold temperature of about 1925° F. (1051° C.) for about 8 hours in vacuum to form the diffused layered coating.

The coated coupon was removed from the furnace and allowed to cool to room temperature. The coated coupon was lightly cleaned by dry honing with 220 mesh aluminum oxide.

Figure 6:
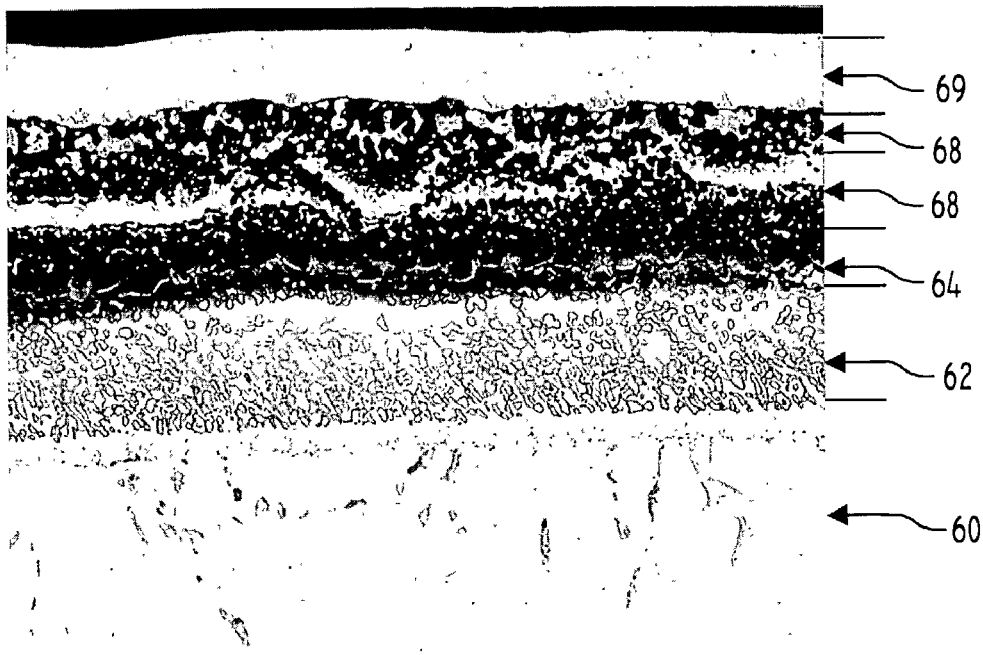
FIG. 6 is a scanned image of a micrograph of one embodiment of a corrosion-resistant layered coating having a CoCrAlY first layer overlaid with a diffused coating derived from a green coating composition containing platinum and silicon, which was prepared as discussed in Example 6 in accordance with this invention, followed by a second green coating of aluminum and chromium.

FIG. 6 shows a scanned image of a micrograph of the, diffused, layered coating of Example 6. As can be seen from micrograph, the diffused coating is typically about 3.4 mils thick. The cobalt-based alloy substrate 60 is overcoated with a multilayer coating. A first intermediate layer 62 contains about 7–8 wt % Al, about 1–2 wt % Pt, 1 wt % Si, about 23–35 wt % Cr, and about 50–63 wt % Co. The next intermediate layer 64 contains about 12–19 wt % Al, about 2–6 wt % Pt, about 1–1.5 wt % Si, about 9–22 wt % Cr, and 57–67 wt % Co. The next intermediate layer 66 contains about 16–21 wt % Al, about 20–54 wt % Pt, about 1–2 wt % Si, about 4–16 wt % Cr, and about 10–52 wt % Co. The surface layer 68 includes about 17–18 wt % Al, about 9–34 wt % Pt, about 1–2 wt % Si, about 10–18 wt % Cr, and about 24–51 wt % Co. Layer 69 is a nickel plate material. The composition of the layers was determined using EDS microprobe techniques.

It is contemplated that processes embodied in the present invention can be altered, rearranged, substituted, deleted, duplicated, combined, or added to other processes as would occur to those skilled in the art without departing from the spirit of the present invention. In addition, the various stages, steps, procedures, techniques, phases, and operations within these processes may be altered, rearranged, substituted, deleted, duplicated, or combined as would occur to those skilled in the art. All publications, patents, and patent applications cited in this specification are herein incorporated by reference as if each individual publication, patent, or patent application was specifically and individually indicated to be incorporated by reference and set forth in its entirety herein.

While the invention has been illustrated and described in detail in the drawings and foregoing description, the same is considered to be illustrative and not restrictive in character, it is understood that only the preferred embodiments have been shown and described and that all changes and modifications that come within the spirit of the invention are desired to be protected.

We claim:

1. A coated article comprising:

a metallic substrate:

a first layer comprising an MCrAl(Y, Hf) alloy, wherein M is selected from the group consisting of: Co. Ni, Fe and mixtures thereof;

a second layer comprising a metallic composition different from the MCrAl(Y,Hf) alloy, said metallic composition selected from the group consisting of; a noble metal, a silicon containing composition; a noble metal, silicon, aluminum containing composition; a noble metal, silicon, chromium containing composition; an aluminum, silicon containing composition; an aluminum, silicon, chromium containing composition; a noble metal, silicon, aluminum, chromium containing composition; a noble metal, silicon, aluminum, chromium, manganese containing composition; and mixtures thereof; and a zone disposed proximate to an interface region between the first layer and the second layer, wherein the zone comprises a first subzone having, in weight percent, about 2% to about 18% Al, about 14% to about 36% Cr, and about 50% to about 68% Co; and wherein the zone further comprises a second subzone having, in weight %, about 6% to about 23% Al, about 26% to about 39% Cr; and about 26% to about 67% Co, and wherein the zone further comprises a third subzone having, in weight percent, about 3% to about 24% Al, about 4% to about 37% Cr, about 8% to about 67% Co, up to about 7% Si, and up to about 76% Pt; and wherein the zone further comprises a fourth subzone having, in weight percent, about 14% to about 20% Al, about 2% to about 34% Pt, about 1% to about 5% Si, about 10% to about 23% Cr, and about 25% to about 51% Co.

2. A coated article comprising:

a metallic substrate;

a first layer comprising an MCrAl(Y, Hf) alloy, wherein M is selected from the group consisting of: Co, Ni, Fe and mixtures thereof;

a second layer comprising a metallic composition different from the MCrAl(Y,Hf) alloy, wherein the metallic composition comprises one or more of the metals selected from the group consisting of: Hf, La, Mn, Y and mixtures thereof; and a zone disposed proximate to an interface region between the first layer and the second layer, wherein the zone is enriched in Cr or Se, or a combination thereof, as compared to the first layer and the second layer.

3. A coated article comprising:

a metallic substrate;

a first layer comprising an MCrAl(Y, Hf) alloy, wherein M is selected from the group consisting of; Co, Ni, Fe and mixtures thereof;

a second layer comprising a metallic composition different from the MCrAl(Y,Hf) alloy, wherein the metallic composition is a noble metal, silicon containing composition; and a zone disposed proximate to an interface region between the first layer and the second layer, wherein the zone is enriched in Cr or Si, or a combination thereof, as compared to the first layer and the second layer.

4. A coated article comprising:

a metallic substrate;

a first layer comprising an MCrAl(Y, Hf) alloy, wherein M is selected from the group consisting of: Co, Ni, Fe and mixtures thereof;

a second layer comprising a metallic composition different from the MCrAl(Y,Hf) alloy, wherein the metallic composition is a noble metal, silicon, aluminum containing composition; and a zone disposed proximate to an interface region between the first layer and the second layer, wherein the zone is enriched in Cr or Si, or a combination thereof, as compared to the first layer and the second layer.

5. A coated article comprising:

a metallic substrate;

a first layer comprising an MCrAl(Y, Hf) alloy, wherein M is selected from the group consisting of: Co, Ni, Fe and mixtures thereof;

a second layer comprising a metallic composition different from the MCrAl(Y,Hf) alloy, wherein the metallic composition is a noble metal, silicon, chromium containing composition; and a zone disposed proximate to an interface region between the first layer and the second layer, wherein the zone is enriched in Cr or Si, or a combination thereof, as compared to the first layer and the second layer.

* * * * *